United States Patent [19]

Igarashi

[11] Patent Number: 4,669,340

[45] Date of Patent: Jun. 2, 1987

[54] SLIP-JOINT PLIERS

[75] Inventor: Tsutomu Igarashi, Sanjo, Japan

[73] Assignee: Igarashi Plier Co., Ltd., Niigata, Japan

[21] Appl. No.: 854,757

[22] Filed: Apr. 22, 1986

[30] Foreign Application Priority Data

Nov. 2, 1985 [JP] Japan ..... 60-169459[U]

[51] Int. Cl.[4] ..... B25B 7/06

[52] U.S. Cl. ..... 81/416; 81/417; 81/394

[58] Field of Search ..... 81/394, 385, 342, 351, 81/417, 416, 415, 341, 393, 384

[56] References Cited

U.S. PATENT DOCUMENTS 1,657,348 1/1928 Drumm ..... 81/417 X

FOREIGN PATENT DOCUMENTS 57-170959 10/1982 Japan .
59-127562 8/1984 Japan .

*Primary Examiner*—Frederick R. Schmidt
*Assistant Examiner*—Marvin A. Rachuba
*Attorney, Agent, or Firm*—Wenderoth, Lind & Ponack

[57] ABSTRACT

Slip-joint pliers have a pair of plier members each having a jaw portion and a handle portion, a pivotal bolt, a nut, and a spring member. The spring member is arcuate and has long and short downward projections. One of the plier members has a bolt whole and an annular groove including a through hole for accommodating the spring member therein. The other plier member has a bolt hole defined by first and second slip changeover holes communicating with each other and an engaging recess contiguously communicating with the first slip changeover hole. The short downward projection of the spring member abuts the wall surface of the through hole and the long downward projection contacts the wall surface of either the first slip changeover hole or the engaging recess to automatically bias open the jaw portions of the pair of plier members.

2 Claims, 6 Drawing Figures

SLIP-JOINT PLIERS

FIELD OF THE INVENTION AND RELATED ART STATEMENT

The present invention relates to slip-joint pliers provided integrally with a mechanism for automatically opening the jaw portions thereof.

Pliers, one type of hand tools, comprises a pair of plier members each having a jaw portion and a handle portion and being attached pivotally to each other with a bolt and a nut so that the jaw portions of the plier members can be opened and closed relative to each other. There have heretofore been proposed such hand tools as pliers having mechanisms for automatically biasing the jaw or nose portions open for working convenience as in Japanese Utility Model Public Disclosure No. 57-170959 and Japanese Utility Model Public Disclosure No. 59-127562, for example. In the former, opposite ends of a twisted coil spring are fixed to respective handle portions of a hand tool at a position in the vicinity of a pivot portion of the hand tool to apply spring pressure to the handle portions, thereby ensuring the automatic jaw or nose portion opened state. The latter has an ordinary coil spring interposed between opposed handle portions of a hand tool in the vicinity of a pivot portion of the hand tool and guarantees the automatic jaw or nose portion opened state by utilization of the spring pressure.

These mechanisms are advantageous in that the jaw or nose portions are automatically opened by a very simple construction. However, since the coil spring serving as a pressure source for opening the jaw or nose portions is interposed between the handle portions is exposed to the outside in either of the conventional mechanisms, it not only makes the hand tool look worse but also constitutes an obstacle when using the hand tool. What is worse, the coil spring exposed to the outside is liable to be damaged and to be deformed owing to accidental external forces in handling the hand tool and therefore has a possibility of failing to sufficiently fulfill its function to automatically open the jaw or nose portions.

OBJECT AND SUMMARY OF THE INVENTION

The main object of the present invention is to provide slip-joint pliers provided integrally with a mechanism for automatically biasing the jaw portions thereof open at all times, which has a very simple construction and is capable of eliminating the aforementioned drawbacks.

To attain the object described above, according to the present invention, there is provided slip-joint pliers which comprise a pair of plier members each having a jaw portion and a handle portion, a pivotal bolt having a rectangular shank, one of the pair of plier members having formed therein a bolt hole of a shape substantially the same as that of the rectangular shank of the pivotal bolt, the other one of the pair of plier members having a portion thereof corresponding to the portion of the bolt hole in the one plier member and comprising a bolt hole having first and second slip changeover holes communicating with each other for permitting adjustment of the opening angle of the jaw portions of the pair of plier members with respect to one another, a spring member formed in a ring shape with a gap and provided on one end thereof with a long downward projection and on the other end thereof with a short downward projection, the one plier member having an annular groove in the outer surface thereof about the bolt hole for accommodating therein the spring member and also having a through hole formed through part of the bottom of the annular groove so as to have a length substantially the same as a distance between the long downward projection and the short downward projection, the short downward projection being stopped by the wall surface of the through hole without projecting downwardly from the through hole and the long downward projection projecting downwardly from the through hole when the ring member has been accommodated within the annular groove, the other plier member having an engaging groove formed in the inner surface thereof contiguous to the first slip changeover hole which defines the bolt hole in the other plier member in conjunction with the second slip changeover hole, the long downward projection of the spring member projecting from the through hole in the one plier member being brought into contact with the wall surface of either the first slip changeover hole or the engaging groove, and a nut for holding the pivotal bolt in place therewith.

The above and other objects, characteristic features and advantages of the present invention will become apparent to those skilled in the art as the disclosure is made in the following description of a preferred embodiment of the invention, as illustrated by the accompanying drawings.

DESCRIPTION OF THE PREFERRED EMBODIMENT

Figure 1:
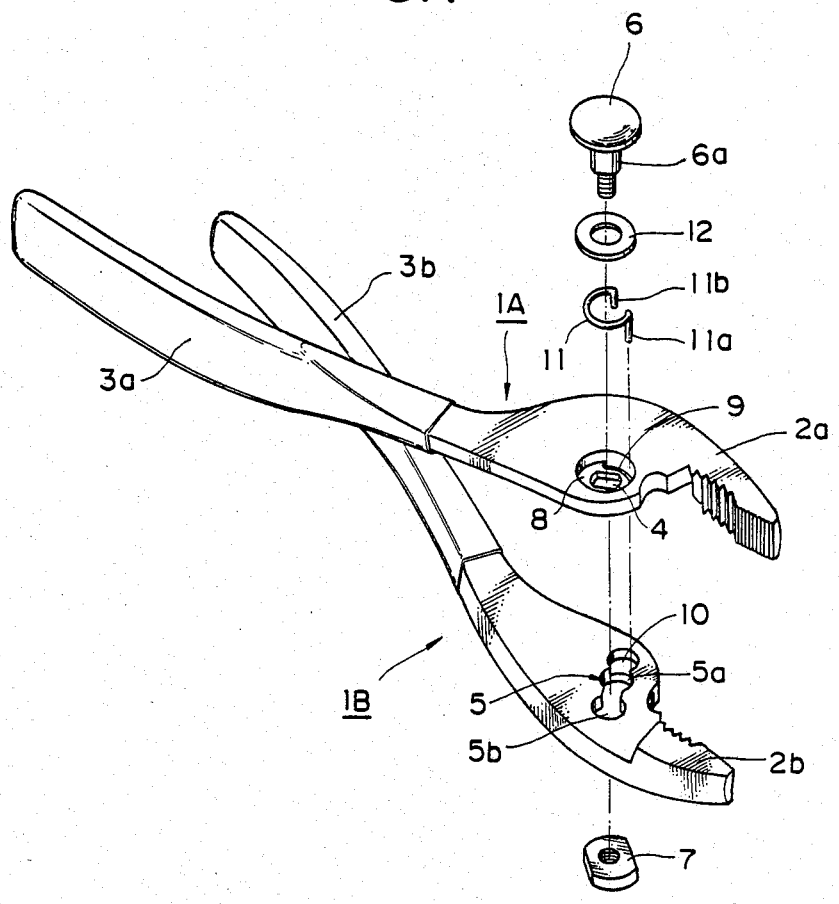
FIG. 1 is an exploded perspective view illustrating one embodiment of the slip-joint pliers according to the present invention.

The present invention will now be described in detail with reference to the illustrated embodiment. As illustrated in FIG. 1, the slip-joint pliers according to the present invention comprise a pair of plier members 1A and 1B having jaw portions **2*a* and 2*b* and handle portions 3*a* and 3*b*, respectively. The plier member 1A has a bolt hole 4 of a shape substantially the same as the shape of a rectangular shank 6*a* of a pivotal bolt 6. The other plier member 1B has in a portion corresponding to the portion of the bolt hole 4 in the one plier member 1A a bolt hole 5 composed of first and second slip changeover holes 5*a* and 5*b* for adjusting the opening angle of the jaw portions 2*a* and 2*b* in two stages. The two plier members 1A and 1B are pivotally attached to each other into slip-joint pliers by passing the pivotal bolt 6 through the two bolt holes 4 and 5, holding the pivotal bolt 6 in place with a nut 7 and calking the leading end of the pivotal bolt 6 projecting from the nut 7, with the result that the jaw portions 2***a* and 2*b* are capable of being close to and apart from each other. The slip-joint pliers of the present invention and ordinarily known slip-joint pliers are common with each other in regard to the aforementioned aspects.

The present embodiment, however, further comprises a spring member 11 serving as a pressure source for opening the jaw portions 2*a* and 2*b*. Further, in this embodiment, the outer surface of the one plier member 1A has a circular recess 8 formed about the bolt hole 4 and communicating with the bolt hole 4 and also has a through hole 9 formed through part of the bottom of the annular groove 8 toward the inner surface of the one plier member 1A. The spring member 11 is completely accommodated within the circular recess 8 including the through hole 9 so as not to project upwardly from the annular groove 8. Further, the inner surface of the other plier member 1B has an engaging recess 10 formed therein so as to contiguously communicate with the first slip changeover hole 5*a* which defines the bolt hole 5 in the other plier member 1B in conjunction with the second slip changeover hole 5*b* and which sets the opening angle of the jaw portions 2*a* and 2*b* larger when it admits the shank 6*a* of the pivotal bolt 6. Denoted by reference numeral 12 in FIG. 1 is a washer interposed between the head of the pivotal bolt 6 and the spring member 11.

To be specific, the spring member 11 is made from a resilient rod or plate material and is formed in the shape of a ring with a gap so as to have one end integral with a long downward projection 11*a* which projects from the through hole 9 toward the side of the other plier member 1B and contacts the wall surface of either the first slip changeover hole 5*a* or the engaging recess 10 when the spring member 11 has been accommodated completely within the circular recess 8 and to also have on other end provided integrally with a short downward projection 11*b* which is engaged with the wall surface of the through hole 9 without projecting downwardly from the through hole 9 in the state of the spring member 11 having completely been accommodated within the circular recess 8. The distance between the long and short downward projections 11*a* and 11*b* across the gap of the spring member 11 is substantially identical with the length of the through hole 9 in the one plier member 1A.

Figure 2:
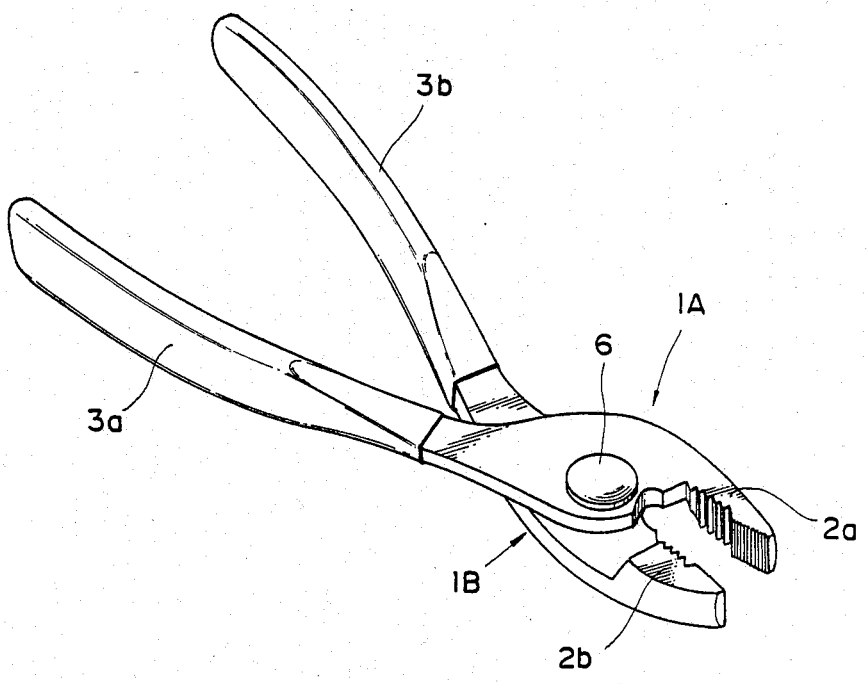
FIG. 2 is a perspective view illustrating the embodiment in an assembled state.

The pair of plier members 1A and 1B are assembled into slip-joint pliers by completely accommodating the spring member 11 within the circular recess 8 with the long and short downward projections 11*a* and 11*b* inserted into the through hole 9, inserting the washer 12 into the through hole 9 on the spring member 11 as the occasion demands, then passing the pivotal bolt 6 through the bolt holes 4 and 5, subsequently holding the pivotal bolt 6 in place with the nut 7, and finally calking the leading end of the pivotal bolt 6 projecting from the nut 7. The slip-joint pliers of the present invention thus assembled is nearly identical in appearance with conventional slip-joint pliers not having a mechanism for automatically opening the jaw portions, as illustrated in FIG. 2, and is used similarly to the conventional slip-joint pliers in the state of the jaw portions 2*a* and 2*b* being set at one of the two adjustable opening angles determined by the engagement of the shank 6*a* of the pivotal bolt 6 in the first and second slip changeover holes 5*a* and 5*b* defining the bolt hole 5 in the other plier member 1B.

Figure 3A:
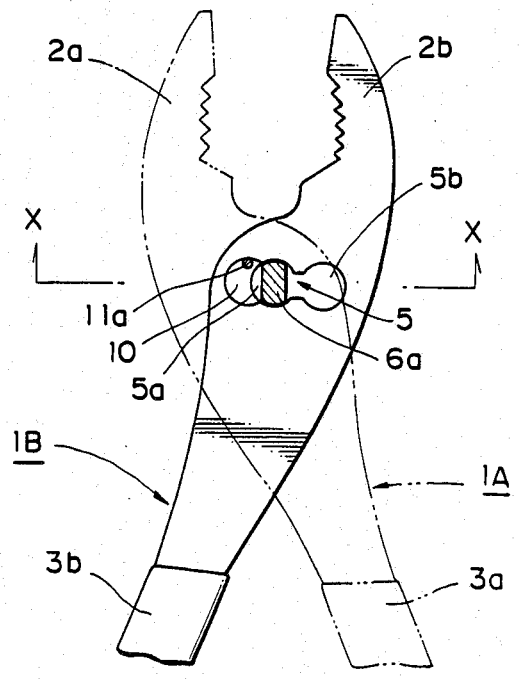
FIG. 3A is a partially cutaway plan view illustrating jaw portions of the embodiment biased open when the shank of a pivotal bolt is engaged in a first slip changeover hole for making the opening angle large.
Figure 3B:
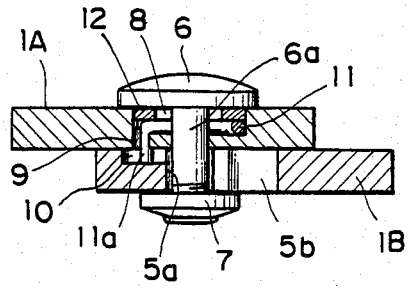
FIG. 3B is a cross-sectional view taken along line X—X in FIG. 3A.
Figure 4A:
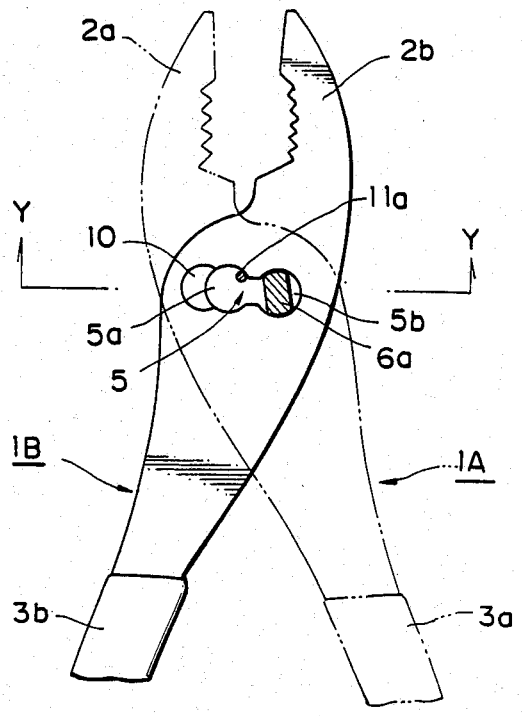
FIG. 4A is a partially cutaway plan view illustrating the jaw portions of the embodiment biased open when the shank of the pivotal bolt is engaged in a second slip changeover hole for making the opening angle small.
Figure 4B:
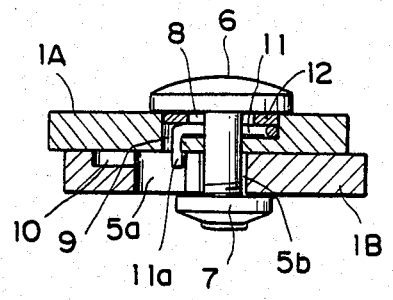
FIG. 4B is a cross-sectional view taken along line Y—Y in FIG. 4A.

In the slip-joint pliers of the present invention, however, when the shank 6*a* of the pivotal bolt 6 is engaged in the first slip changeover hole 5*a* for making the opening angle of the jaw portions 2*a* and 2*b* larger, the short downward projection 11*b* of the spring member 11 contacts the wall surface of the through hole 9 and, as shown in FIGS. 3A and 3B, the leading end of the long downward projection 11*a* projecting downwardly from the through hole 9 contacts the wall surface of the engaging groove 10 contiguously communicating with the first slip changeover hole 5*a* to apply the spring pressure produced by the long downward projection 11*a* to the other plier member 1B, thereby biasing the handle portion 3*b* of the other plier member 1B from the handle portion 3*a* of the one plier member 1A and thus causing an automatic opened state of the jaw portions 2*a* and 2*b*. On the other hand, when the shank 6*a* of the pivotal bolt 6 is moved to and engaged in the second slip changeover hole 5*b* for making the opening angle of the jaw portions 2*a* and 2*b* smaller, as illustrated in FIGS. 4A and 4B, the long downward projection 11*a* of the spring member 11 moves from the engaging groove 10 to the first slip changeover hole 5*a* and contacts the wall surface of the first slip changeover hole 5*a* to apply the spring pressure produced by the long downward projection 11*a* to the other plier member 1B, thereby biasing the handle portion 3*b* of the other plier member 1B from the handle portion 3*a* of the one plier member 1A and thus causing the automatic opened state of the jaw portions 2*a* and 2*b*. In either case, when the handle portions 3*a* and 3*b* are grasped when using the slipjoint pliers, the long downward projection 11*a* of the spring member 11 is pressed against the wall surface of either the engaging recess 10 or the first slip changeover hole 5*a* to be flexed toward the short downward projection 11*b* within the through hole 9 due to its resiliency, thereby allowing the handle portions 3*a* and 3*b* to move close to each other. Therefore, the slip-joint pliers of the present invention can be used without hindrance. As soon as the grasp is released, the spring pressure of the long downward projection 11*a* of the spring member 11 acts on the other plier member 1B to automatically the jaw portions 2*a* and 2*b*.

As described above, according to the present invention, since the spring member serving as a pressure source for automatically opening the jaw portions of the pair of plier members is completely accommodated within the annular groove formed about the bolt hole in one of the plier members, it is not exposed to the outside and therefore not only makes the slip-joint pliers look better as compared with the related art cited herein but also solves the problems of an obstacle in the use of the slip-joint pliers and damage or deformation owing to accidental external forces which have been posed by the spring members of the related art. Further, since the small downward projection of the spring member contacts the wall surface of the through hole in one of the plier members whereas the long downward projection of the spring member contacts the wall surface of the engaging groove in the other plier member when the shank of the pivotal bolt is engaged in one of the two slip changeover holes constituting the bolt hole in the other plier member and with the wall surface of the one slip changeover hole when the shank of the pivotal bolt is engaged in the other slip changeover hole, pressure produced by the long downward projection is exerted on the other plier member in either of the two states and, therefore, the automatic opening of the jaw portions of the pair of plier members can precisely be ensured.

What is claimed is:

1. Slip-joint pliers comprising:

a first plier member having a handle portion and a jaw portion;

a second plier member having a handle portion and a jaw portion, said second plier member pivotally and slidably mounted relative to said first plier member at a section intermediate said handle and said jaw portions for being pivotable relative to said first plier member at a first position and for being slidable relative to said first plier member between said first position and a second position at which said second plier member is pivotable relative to said first plier member;

said first plier member having a circular spring receiving recess in one side thereof at said intermediate section, a substantially rectangular bolt hole extending therethrough at the center of said circular recess, and a through hole extending therethrough located at the periphery of said circular recess;

said second plier member having a bolt hole extending therethrough at said intermediate section comprising a first circular changeover hole, an intermediate rectangular hole open to and communicating with said first circular changeover hole and a second circular changeover hole open to and communicating with said intermediate rectangular hole opposite from said first changeover hole, and an engaging recess in one side thereof adjacent said first plier member and open to said first circular changeover hole opposite said intermediate rectangular hole;

an arcuate spring for biasing said first and second plier members apart when at said first and second positions, said spring in and extending along the periphery of said circular recess around said bolt hole of said first plier member, a first end of said arcuate spring extending into said through hole at one end thereof and having a length no greater than the depth of said through hole, a second end of said arcuate spring projecting from said first plier member toward said second plier member;

a bolt having a substantially rectangular shank extending through said substantially rectangular bolt hole of said first plier member, said shank comprising first and second convex opposite end faces of a corresponding curvature to said first and second changeover hole sections and said shank comprising first and second opposite side faces extending between said end faces respectively, said shank having a width between said side faces substantially equal to the length of said rectangular intermediate hole, said shank having a length between said end faces greater than that of said intermediate rectangular hole, said shank extending into said first changeover hole and said other end of said arcuate spring extending into and abutting against the edge of said engaging recess when said second plier member is in said first position relative to said first plier member, and said rectangular shank extending in said second changeover hole and said other end of said spring extending into and abutting against the side of said first changeover hole when said second plier member is in said second position relative to said first plier member; and a nut for securing said bolt to said first and second plier members.

2. Slip-joint pliers as claimed in claim 1, wherein said through hole is arcuate, said first end of said arcuate spring extends into said arcuate through hole at one end thereof and has a length no greater than the depth of said arcuate through hole, and said second end of said arcuate spring extends through said arcuate through hole at the other end thereof and projects from the first plier member toward said second plier member.

* * * * *